US009187867B2

(12) United States Patent
Male et al.

(10) Patent No.: US 9,187,867 B2
(45) Date of Patent: Nov. 17, 2015

(54) PAVEMENT FOR VEHICLES AND PEDESTRIANS

(71) Applicant: TERREAL, Suresnes (FR)

(72) Inventors: Philippe Male, Toulouse (FR); Paul Vincent, Paris (FR)

(73) Assignee: TERREAL, Suresnes (FR)

( * ) Notice: Subject to any disclaimer, the term of this patent is extended or adjusted under 35 U.S.C. 154(b) by 0 days.

(21) Appl. No.: 14/190,259

(22) Filed: Feb. 26, 2014

(65) Prior Publication Data

US 2015/0240429 A1 Aug. 27, 2015

(51) Int. Cl.

| | |
|---|---|
| ***E01C 9/08*** | (2006.01) |
| ***E01C 9/00*** | (2006.01) |
| ***E01C 15/00*** | (2006.01) |
| ***E01C 5/00*** | (2006.01) |

(52) U.S. Cl.

CPC ..... *E01C 9/002* (2013.01); *E01C 5/003* (2013.01); *E01C 5/005* (2013.01); *E01C 9/004* (2013.01); *E01C 15/00* (2013.01)

(58) Field of Classification Search

CPC ..... E01C 5/003; E01C 5/005; E01C 9/002; E01C 9/004; E01C 15/00

USPC ..... 404/14, 36, 47, 73

See application file for complete search history.

(56) References Cited

U.S. PATENT DOCUMENTS

| | | | | |
|---|---|---|---|---|
| 1,422,193 | A | 7/1922 | Sullivan et al. | |
| 2,092,106 | A * | 9/1937 | Coddington | 264/112 |
| 2,215,159 | A | 9/1940 | Rothmann | |
| 2,723,607 | A | 4/1951 | Paquin-Kleinermann | |
| 3,092,371 | A * | 6/1963 | Knudsen | 256/13.1 |
| 4,496,264 | A * | 1/1985 | Casey | 404/6 |
| 5,028,463 | A * | 7/1991 | Cahill et al. | 428/35.7 |
| 8,061,925 | B2 * | 11/2011 | Volkmann | 404/6 |

FOREIGN PATENT DOCUMENTS

| | | |
|---|---|---|
| BE | 538937 | 6/1955 |
| DE | 2733311 | 2/1979 |
| DE | 20214938 | 12/2002 |
| EP | 0079492 | 5/1983 |

OTHER PUBLICATIONS

French Search Report and Opinion FR 1254188, Jan. 23, 2013.
European Patent Search Report and Opinion EP 13166658, Jul. 23 2013.

* cited by examiner

*Primary Examiner* — Raymond W Addie
(74) *Attorney, Agent, or Firm* — Notaro, Michalos & Zaccaria P.C.

(57) ABSTRACT

A pavement for vehicles and pedestrians, which is formed by a conventional foundation of stones and sand on which there are placed parallel alignments of elongate construction elements having an upper part and a lower part that are connected together by a narrowed intermediate part, the space between the narrowed parts of two adjacent alignments being filled with soil or compost in which a decorative plant is planted and a mechanism being arranged to achieve the regularity of the spacing between the alignments and the stability thereof.

17 Claims, 13 Drawing Sheets

PAVEMENT FOR VEHICLES AND PEDESTRIANS

FIELD AND BACKGROUND OF THE INVENTION

The present invention relates to a pavement for vehicles and pedestrians which, while allowing a good flow of traffic, has a very particular decorative appearance.

Such a pavement having a decorative effect is described in the patent U.S. Pat. No. 2,215,159 of Apr. 30, 1938.

According to said patent, this surface is formed by a conventional foundation on which there are placed cement blocks having a convex upper surface and a flat lower surface, said surfaces being connected together by a narrowed intermediate part, the space between the narrowed parts of two adjacent elements being filled with soil or compost in which a decorative plant is planted.

According to said patent, the blocks are arranged at 90° with respect to one another.

This arrangement has the drawback of providing an unstable surface on account of the fact that the upper surface of the blocks is curved, such that said blocks tend to vibrate laterally during the passage of vehicles.

The German patent 27 33 311 of Jul. 23, 1977 describes means of stabilizing blocks placed side-by-side, said means being formed by rods having a circular section which are inserted into circular recesses, this not making it possible to obtain good vertical stabilization.

The patent U.S. Pat. No. 2,723,607 describes paving made of longitudinal elements that are placed side-by-side and secured together so as to produce slabs. This paving does not make it possible to arrange soil or compost, in which a decorative plant is planted, between the longitudinal elements.

The present invention relates to a pavement for vehicles and pedestrians formed by construction elements having an upper surface and a flat lower surface which are connected together by a narrowed intermediate part, the space between the narrowed parts of two adjacent construction elements being filled with soil or compost in which a decorative plant is planted, wherein the construction elements have an elongate shape and are arranged end-to-end so as to form parallel straight lines, the upper surface of the construction element being flat, and stabilizing means being arranged so as to cooperate with the construction elements of two adjacent lines in order to improve the vertical and lateral stability of the latter, the construction elements having longitudinal recesses, the stabilizing means having securing pieces interposed between the construction elements of a line, the securing piece having a body which is arranged between the longitudinal ends of two construction elements placed end-to-end and carries rods or protuberances able to be housed in the longitudinal recesses in the two construction elements between which said body is arranged so as to maintain the alignment of the two construction elements.

SUMMARY OF THE INVENTION

According to embodiments, such a pavement may have one or more of the following features.

According to one embodiment, the securing pieces have projecting parts for keeping the spacing between the two adjacent lines of construction elements constant.

According to one embodiment, the construction element is produced from ceramic material. As a variant, such construction elements may be produced from other materials, for example cement or concrete. According to embodiments, the construction element is solid or has longitudinal recesses.

According to embodiments, the narrowed intermediate part of the construction element is realized by two opposite dihedrons or by two curved elements having opposite curvatures.

According to one embodiment, the lower and upper surfaces are at one and the same distance from a neck part of the construction element having a minimum thickness.

According to one embodiment, the lower part located between the neck and the lower surface has a height greater than that of the upper part located between the neck and the upper surface.

According to one embodiment, the lower part located between the neck and the lower surface has a height less than that of the upper part located between the neck and the upper surface and a smaller width.

According to one embodiment, the stabilizing means have spacing means for keeping the spacing between the two adjacent lines of construction elements constant.

According to one embodiment, the construction elements have means for fixing the alignments of the construction elements, consisting of three rods arranged in a triangle, the upper rod being threaded into a longitudinal recess in two construction elements placed end-to-end, the two lower rods being pressed laterally against the sides of the lower parts of the construction elements.

According to a corresponding embodiment, the stabilizing means are formed by a fastener having two pairs of lateral arms located in a plane perpendicular to the alignments, each pair of arms bearing against the lateral face of an adjacent construction element.

According to one embodiment, the fastener has, in addition to the two pairs of lateral arms, two horizontal protuberances, located on each side of the fastener, these protuberances being inserted into the central recesses in two construction elements placed end-to-end, when these elements are not solid but have longitudinal recesses.

According to one embodiment, the ends of the arms are provided with feet, the shape of which corresponds to the profile of the lateral surfaces of the construction elements against which said feet bear.

According to one embodiment, the arms are curved and provided at their ends with bearing means having, on one side, three walls arranged in a U-shape, the bases of the Us being shaped so as to correspond to the curvature of the sidewalls of the construction elements against which they bear; on the other side an anchoring wedge.

According to one embodiment, the thickness of said arms is between 3 and 5 mm.

According to one embodiment, the body of the securing piece also carries spacing rods that are arranged on either side of the line of construction elements and extend parallel to the line of construction elements. Thus, the construction elements are for example kept in the appropriate aligned position by three rods arranged in a triangular manner, the upper rod being threaded into a recess made in the upper part of the construction element, the two lower rods being pressed against the sides of the lower part thereof.

According to embodiments, the body of the securing piece has a plate in the shape of an inverted T, a triangular plate or a pair of oblique bars.

According to one embodiment, the invention also provides a construction element suitable for producing a pavement for vehicles and pedestrians, formed by an elongate solid body having: a lower part, the flat longitudinal surface of which is able to be placed on a conventional foundation; an upper part, the flat longitudinal surface of which is able to form said pavement, and an intermediate part having a narrowed width between the lower surface and the upper surface.

According to one embodiment, the construction elements have a length of between 0.30 m and 1.80 m, a height of 50 to 150 mm, a width of 35 to 100 mm, the alignments being spaced apart from one another by 15 mm to 20 mm.

According to one embodiment, the upper part of the construction element has a width of around 57 mm and a height of around 13 mm, the lower part having a width of around 43 mm and a height of around 4 mm; only the upper and intermediate parts have a longitudinal recess.

According to one embodiment, the spacing between two adjacent alignments of construction elements is determined by an assembly consisting of two adjacent securing pieces and a connecting member arranged between the two securing pieces.

According to one embodiment, the connecting member is a third securing piece.

The invention will be better understood, and further aims, details, features and advantages thereof will become more clearly apparent from the following description of a number of particular embodiments of the invention, these being given only by way of nonlimiting illustration, with reference to the appended drawings.

DESCRIPTION OF THE PREFERRED EMBODIMENTS

Figure 1:
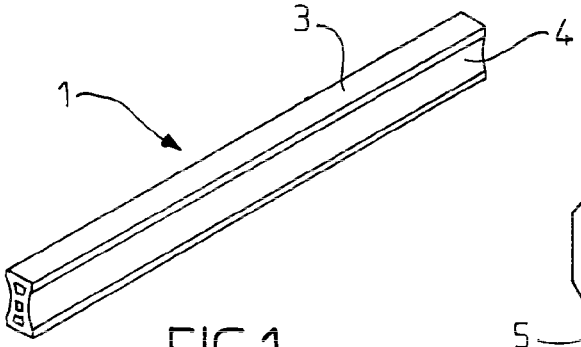
FIG. 1 is a perspective view of an exemplary embodiment of the construction element.
Figure 2:
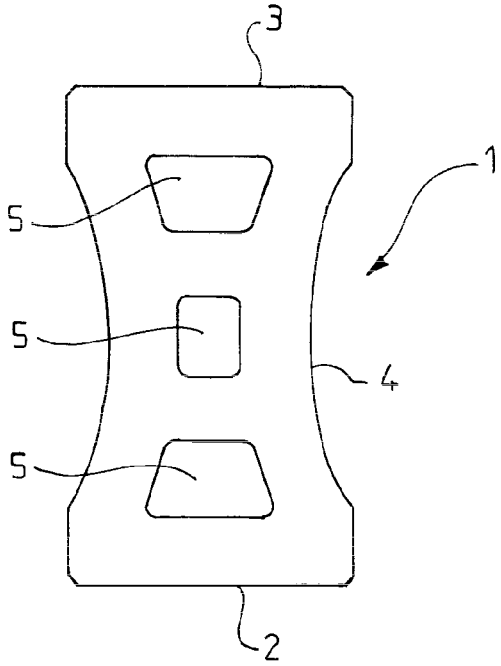
FIG. 2 is a cross-sectional view of the construction element from FIG. 1.

With reference to FIGS. 1 and 2, it can be seen that the construction element is formed by an elongate solid body 1, having: a lower part having a flat surface 2, an upper part having a flat surface 3, an intermediate part 4 located between the lower and upper parts, this intermediate part 4 being narrowed, that is to say that it has a width smaller than that of the lower surface 2 and upper surface 3. The intermediate part 4 is produced by two opposite curved surfaces, such that its width is smaller than that of the surfaces 2 and 3; it is thus narrowed.

Figure 3:
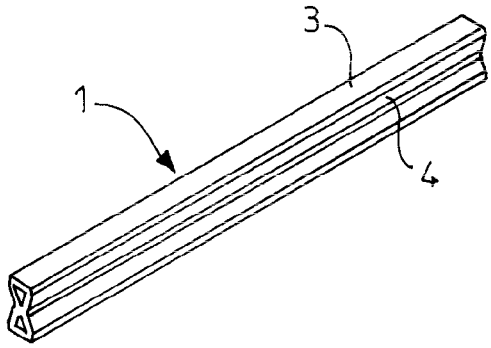
FIG. 3 is a perspective view of a second exemplary embodiment of the construction element.
Figure 4:
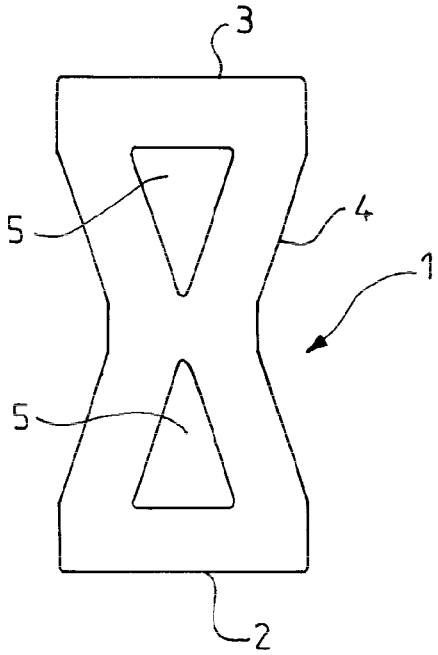
FIG. 4 is a cross-sectional view of the construction element from FIG. 3.

FIGS. 3 and 4 illustrate a variant embodiment in which the narrowed part 4 is formed by two opposite dihedrons.

In the two examples shown, the upper and lower parts have the same height on either side of the narrow part, but it is possible for them to have different heights, the lower part having for example a greater or smaller height.

As is shown in FIGS. 1 to 4, the construction elements 1 are hollow bricks having an elongate shape such that they have longitudinal recesses 5.

Preferably, as is shown in FIGS. 1 to 4, longitudinal recesses 5 are formed in a manner known per se. Such recesses make it easier to fire and dry the material for manufacturing from ceramic or terracotta. Alternatively, the elements 1 may be solid.

The construction elements 1 thus produced are placed end-to-end so as to form alignments which are arranged parallel to one another, being spaced apart by 1 to 2.5 cm, on a foundation of stones and sand, such that the flat faces of the upper parts of the elements 1 form a surface on which vehicles or pedestrians can travel. The spacing between two adjacent lines should be sufficiently small for pedestrian use, in particular so as to avoid the wheels of wheelchairs becoming jammed.

Arranged in the space 6 formed between two lines of elements 1 is fertile soil or compost 12 in which a plant 13 is planted, grass in the example shown. A particularly original pavement for vehicles and pedestrians is thus obtained, combining utility (traffic) and esthetics (decorative appearance).

In order to stabilize the construction elements 1 and ensure a regular spacing between the lines of elements 1, fixing devices such as those described in FIGS. 5 to 13 are arranged between them.

Figure 5:
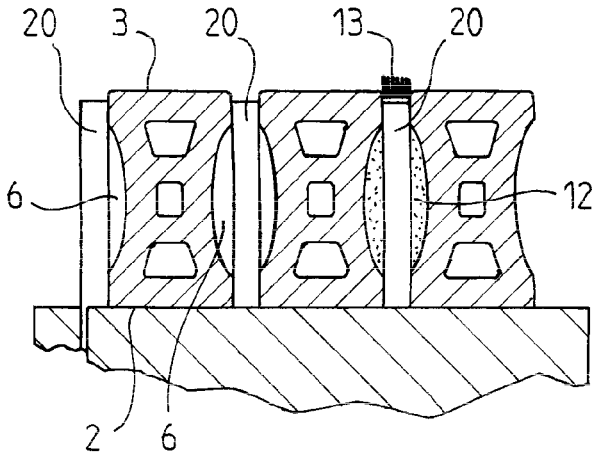
FIGS. 5, 6 and 7 illustrate three methods of fixing the construction elements so as to produce parallel lines.
Figure 6:
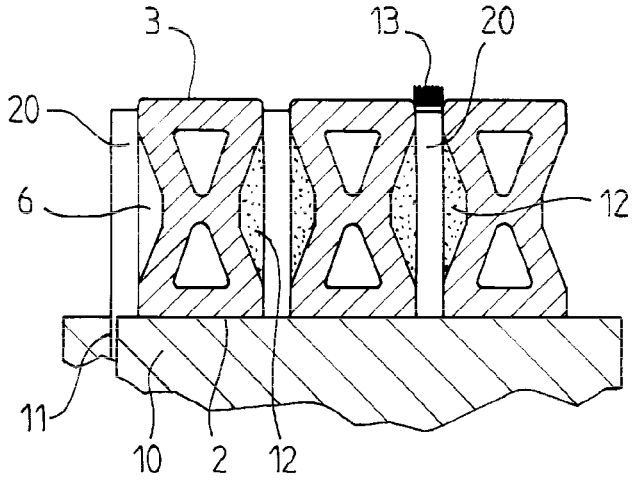
Figure 7:
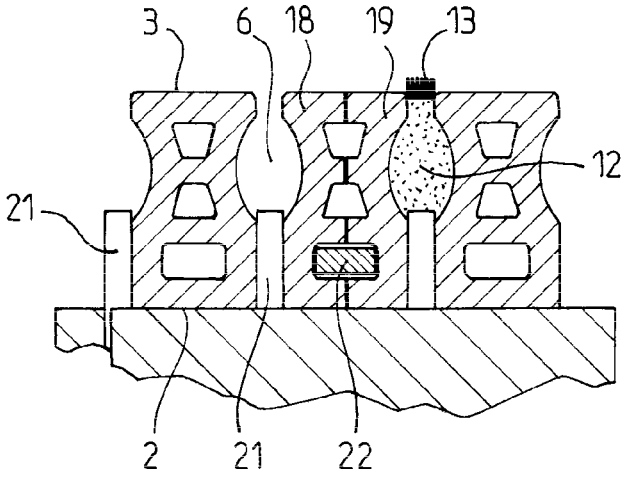

FIGS. 5 and 7 show construction elements 1 corresponding to FIGS. 1 and 2, while FIG. 6 shows construction elements corresponding to FIGS. 3 and 4.

It can be seen in FIGS. 5 and 6 that, between two adjacent lines of construction elements 1, there are arranged strips 20, the width of which is equal to the desired spacing between the alignments and the height of which is approximately equal to that of the elements 1 of which said lines are made. The strip 20 preferably has a part 11 sunk into the foundation 10 along a particular length that is sufficient for the stability thereof.

In FIG. 7, it can be seen that the construction elements 1 have a lower part having a height greater than the upper part. Arranged between the lower part of two adjacent lines are strips 21 having the same height as the lower part of the construction elements 1.

According to a variant embodiment also illustrated in FIG. 7, construction elements 1 are cut vertically into two symmetrical half-elements 18 and 19, which are joined together by means of a parallelepipedal block 22 placed in the recess 5 in the lower part 2.

Figure 8:
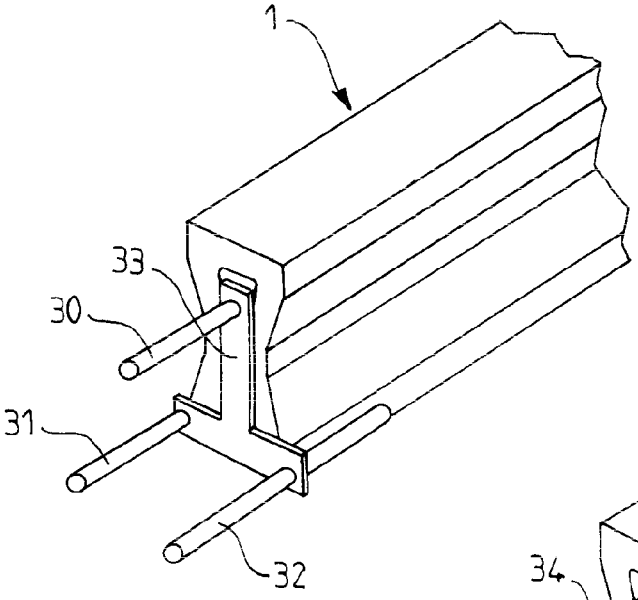
FIGS. 8, 9 and 10 illustrate three other methods of fixing the construction elements of a line.
Figure 9:
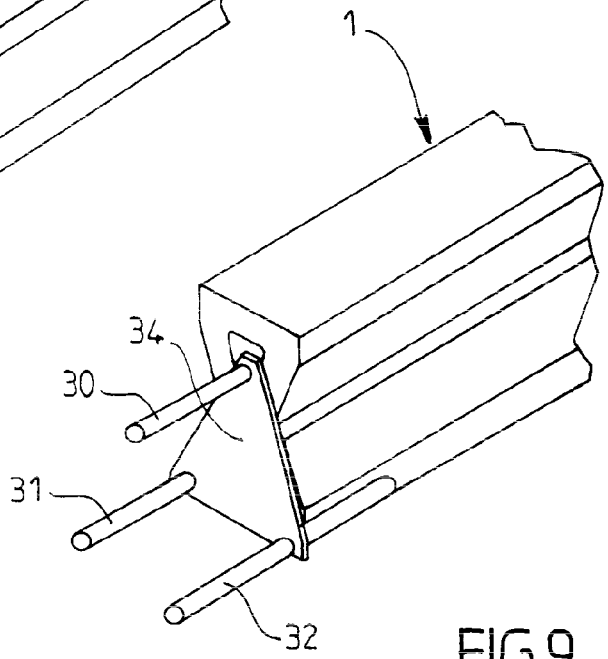
Figure 10:
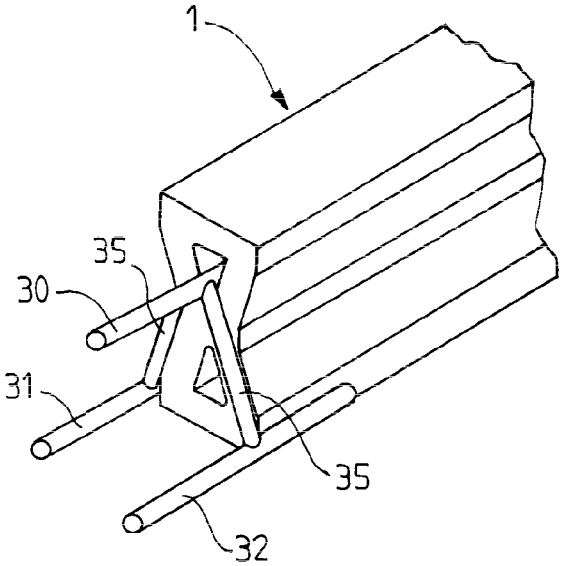

FIGS. 8 to 10 shows three other methods of fixing the alignments of construction elements 1.

In these three figures, it can be seen that three rods 30, 31 and 32 are arranged at the end of a construction element 1. These rods are arranged in a triangle, the upper rod 30 being threaded into the longitudinal recess 5 located in the upper part of the construction element 1. The lower rods 31 and 32 are pressed laterally against the sides of the lower part 2. The rods 31 and 32 ensure the regularity of the lateral spacing of the alignments of construction elements 1, while the rod 30 ensures that said construction elements 1 are kept in the aligned position.

According to the embodiment in FIG. 8, the three rods 30, 31 and 32 are held by a body part 33 in the form of an inverted T. According to the embodiment in FIG. 9, the three rods are fixed to the three corners of a triangular body part 34. According to the embodiment in FIG. 10, the three rods 30, 31 and 32 are joined together by two oblique bars 35.

Figure 11:
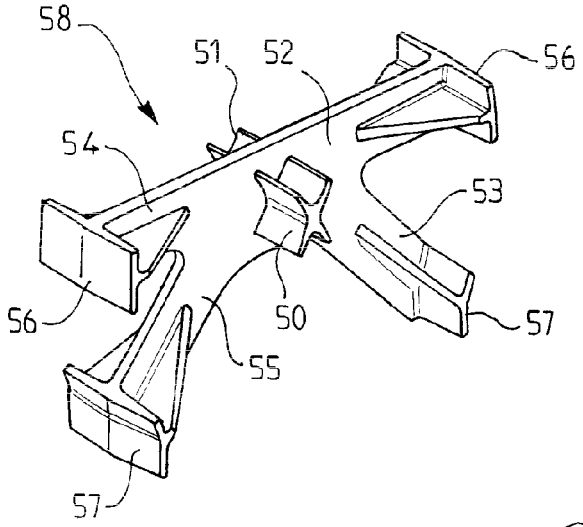
FIGS. 11 to 13 illustrate a fastener for securing the construction elements.
Figure 12:
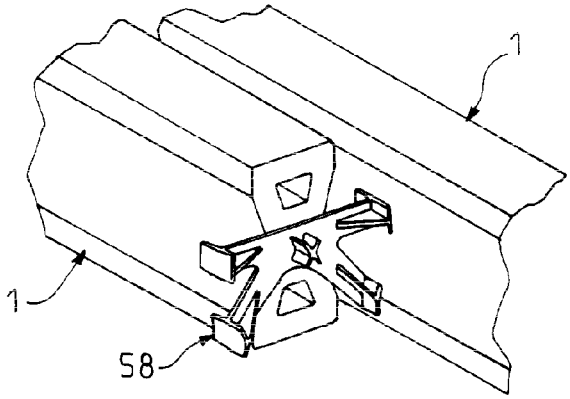
Figure 13:
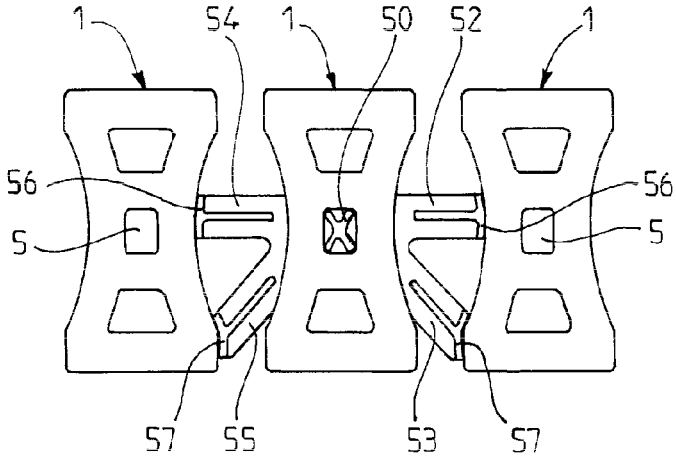
Figure 14:
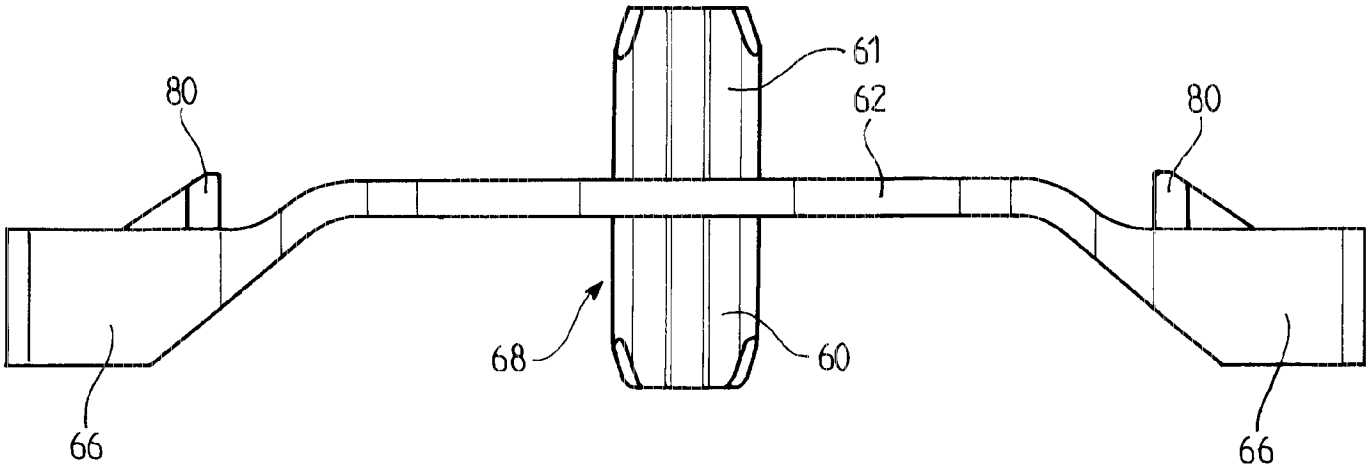
FIG. 14 is a plan view of a second embodiment of a fastener for ensuring the longitudinal connection of the construction elements and the lateral stabilization thereof.

FIGS. 11 to 13 illustrate a fastener device 58 which fulfills six functions, namely: end-to-end alignment of the construction elements 1 of a line; expansion joint between two elements 1 of a line; determination of the space separating two lines of elements 1; anti-lifting effect of said construction elements 1; anti-rotation, that is to say vertical stability of said construction elements 1; simplicity and rapidity of placement.

FIG. 11 shows the fastener 58: it has two central protuberances 50/51 and two pairs of lateral arms 52/53 on one side and 54/55 on the other, said pairs of lateral arms being located in a plane perpendicular to the alignments; the horizontal upper arms 52 and 54 being provided at their ends with a curved foot 56, the curvature of which corresponds to that of the middle of the curved intermediate part 4; the oblique lower arms 53 and 55 being provided at their ends with a foot 57 that matches the angular shape of the junction between the lower part 2 of the construction element 1 and the intermediate part 4.

The protuberances 50, 51 are cruciform so as to be locked in the corners of the recesses 5, which have a rectangular section.

In FIGS. 12 and 13, it can be seen that the central protuberances 50/51 are inserted into the recesses 5 which are located in the middle of two construction elements 1 placed end-to-end. This ensures the alignment of the construction elements. In addition, the fastener forms an expansion joint.

The lateral arms determine the space separating two alignments; they ensure the vertical stability thereof and, by securing the alignments to one another, they prevent any lifting.

The fastener 58 thus formed is produced from a material having a thickness between 3 and 5 mm, having a certain elasticity: metal strip having a small thickness or plastics material, and the projections 50/51 are force-fitted into the recesses 5, thereby rigidifying the alignment of the construction elements 1. FIG. 13 illustrates the way in which a fastener 58 is fixed in the recess 5 of an element 1 and bears against two other elements 1 located on each side.

FIGS. 14 to 20 illustrate a second embodiment of the fastener 58 from FIGS. 11 to 13.

In a similar manner, the fastener 68 has two central protuberances 60, 61 having a cruciform section and two pairs of lateral arms 62, 63, on one side, and 64, 65, on the other, said pairs of lateral arms being located in a plane perpendicular to the protuberances 60, 61.

These four arms have a curved shape so as to have a certain amount of elasticity.

In the same way as the four arms of the fastener 68 are provided at their ends with feet 56 and 57 that are intended to bear against the sidewalls of the two construction elements 1, which are located on each side of the element 1 carrying the fastener 68, the four arms 62, 63, 64 and 65 are provided at their ends with bearing means 66; the lower arms 63 and 65 are provided at their ends with bearing means 67.

These bearing means have a particular shape. They have three walls 70, 71 and 72 for the bearing means 66, and 73, 74, 75 for the bearing means 67, these walls being arranged in a U-shape.

Figure 17:
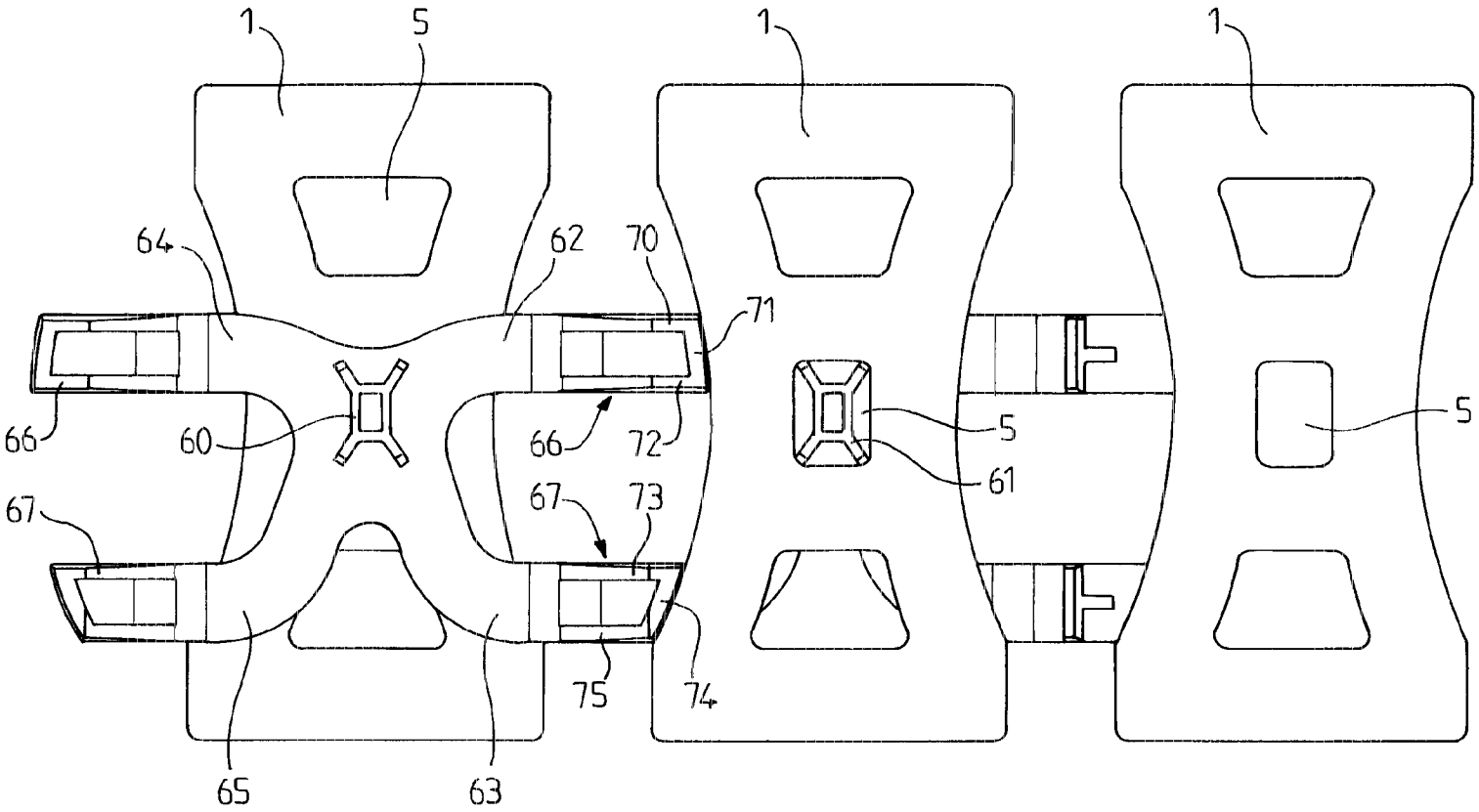
FIG. 17 is a front view of three lines of construction elements joined together by fasteners according to FIGS. 14, 15 and 16.

The middle wall 71 of the bearing means 66 and the wall 74 of the bearing means 67 are inclined so as to correspond to the curvature of the sidewalls of the construction elements 1 against which they bear, as is shown in FIG. 17.

In addition, each arm 62, 63, 64 and 65 is provided, on the opposite side to the bearing means 66 and 67, with a wedge 80, the position of these wedges 80 being determined such that these wedges bear against one another when the fasteners 68 are fitted.

Figure 18:
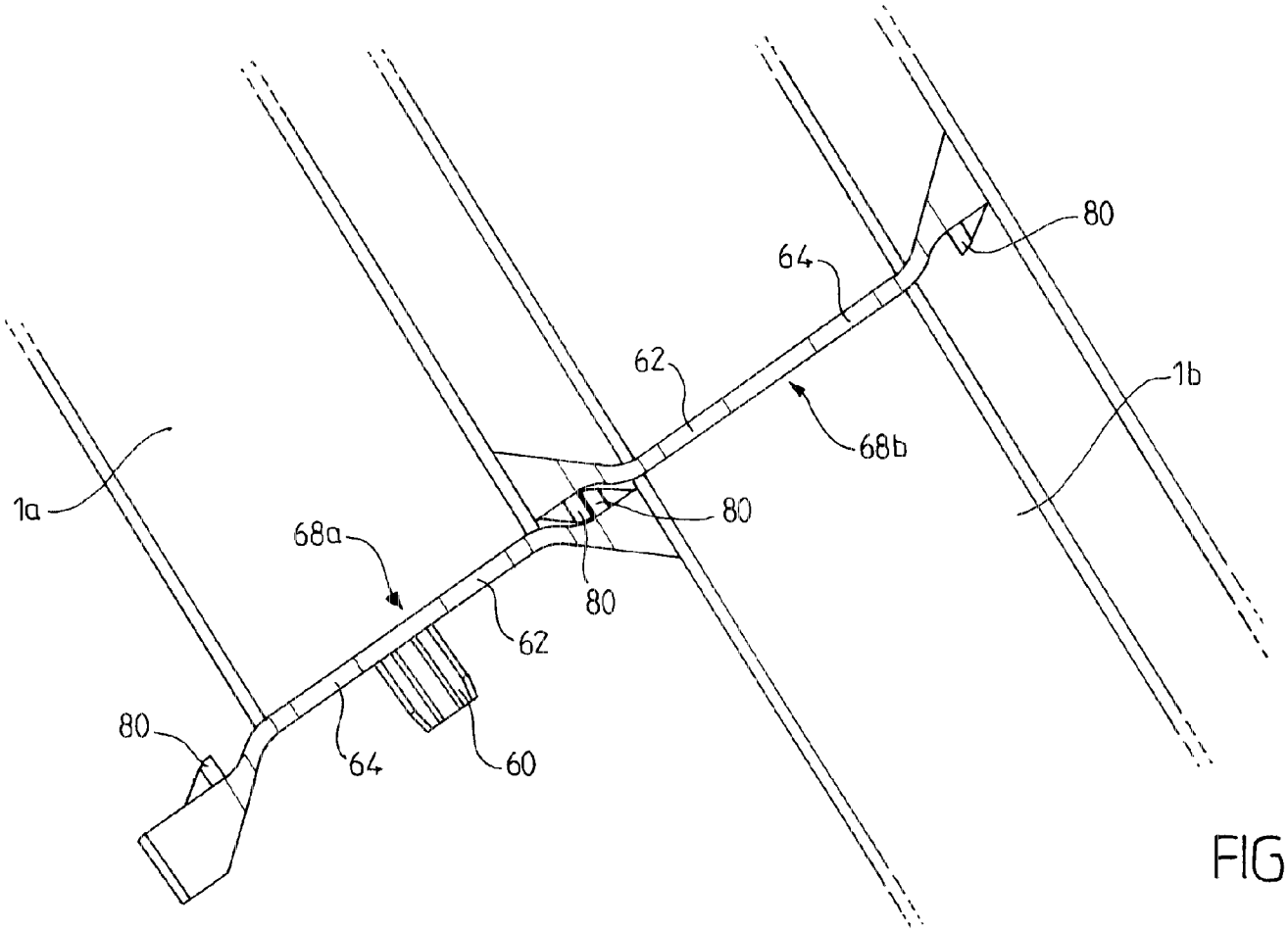
FIG. 18 is a top view of two adjacent lines of construction elements provided with two fasteners according to FIGS. 14 to 17.
Figure 19:
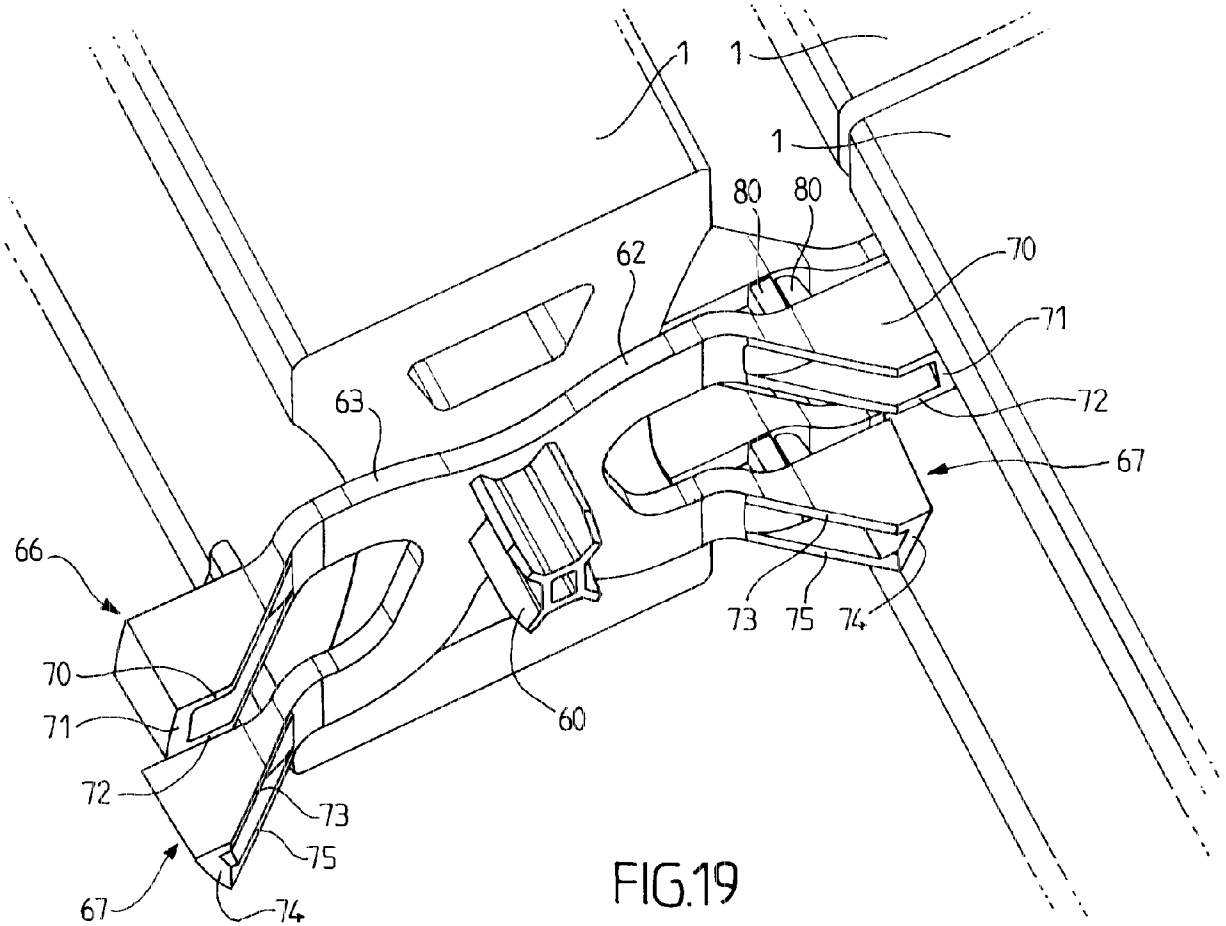
FIG. 19 is a perspective view corresponding to FIG. 18.

FIG. 18 shows a construction element of a line of elements 1*a* and two construction elements of an adjacent line 1*b*.

It can be seen that the two fasteners 68*a* and 68*b*, the fastener 68*a* being at the end of 1*a* and the fastener 68*b* being between two elements of the adjacent line 1*b*, are in inverted positions, thereby enabling the wedges 80 of the two fasteners 68*a* 10 and 68*b* to be anchored against one another, thereby preventing the two lines 1*a* and 1*b* from moving apart.

In order that this anchoring of the wedges 80 is possible, it is necessary for the ends of the arms 62, 63, 64 and 65 to be laterally offset with respect to the plane of the fastener 68, as is shown.

Figure 20:
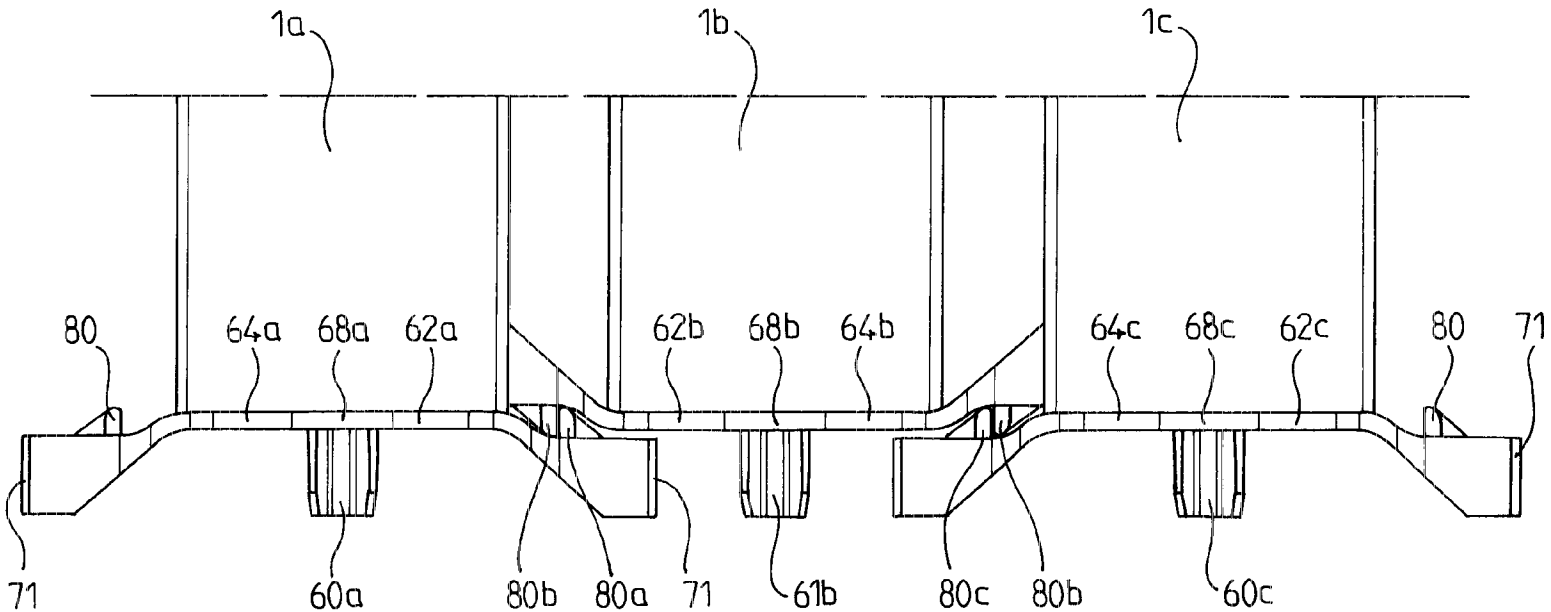
FIG. 20 is a plan view illustrating three parallel lines of construction elements joined together by three fasteners.

FIG. 20 shows three construction elements 1*a*, 1*b* and 1*c* of three adjacent lines of construction elements 1.

It can be seen that, from one line to another, the fasteners 68*a*, 68*b*, 68*c* are in inverted positions such that the wedges 80*a* and 80*b*, on one side, and 80*c* and 80*d*, on the other, are anchored against one another.

By way of nonlimiting example, the construction elements 1 have a length of between 0.30 m and 1.80 m and a height of between 50 and 150 mm, a width of between 35 and 100 mm, the alignments being spaced apart from one another by 15 to 20 mm. According to a preferred embodiment, the width of the intermediate space that receives the compost does not exceed 28.75 mm.

Figure 21:
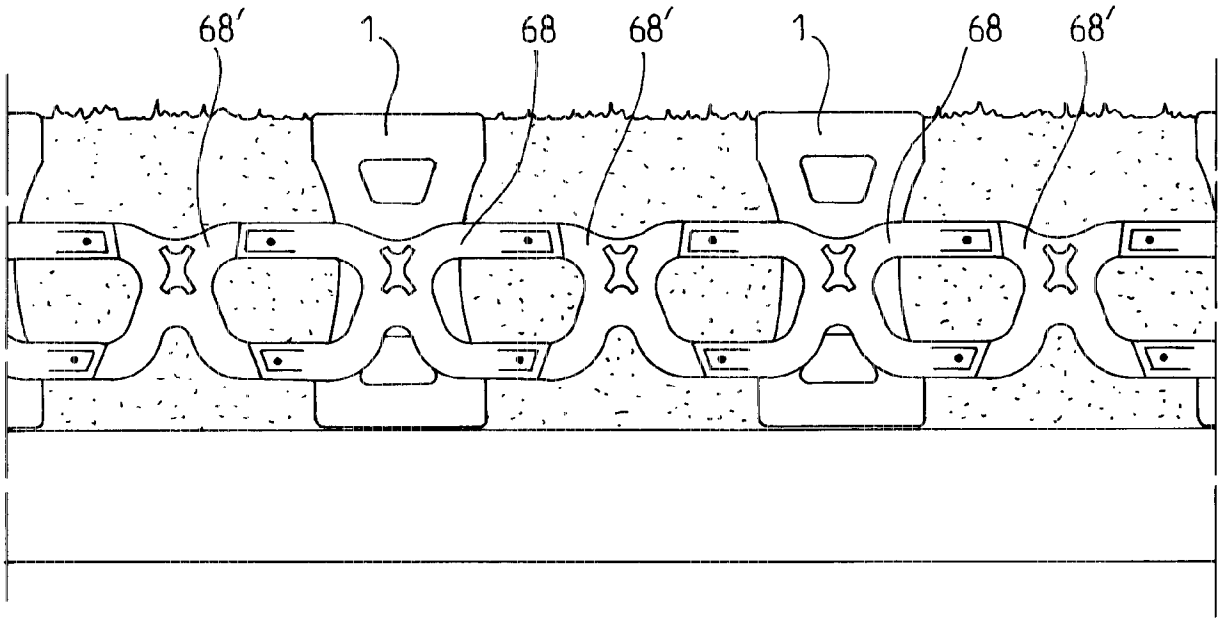
FIG. 21 is a view corresponding to FIGS. 17, 18, 19 and 20, in which a connecting member is formed by an additional securing piece.

In the examples shown in FIGS. 12, 13, 17 to 20, the distance between two alignments of construction elements 1 is determined by the length of the arm of a fastener, being for example between 15 and 20 mm. An embodiment that makes it possible to increase this distance is shown in FIG. 21.

In this figure, it can be seen that an additional fastener 68' has been arranged between two fasteners 68, this having the effect of increasing the spacing between two alignments of construction elements 1 by the width of the fastener 68'.

It should be noted that it is possible, voluntarily, to modify the width of the space between two alignments by arranging between two fasteners 68 not a fastener 68' identical to the fasteners 68, but any connecting member of desired width.

Similarly, it is possible to arrange between two fasteners 68 connecting members having dimensions which differ from one alignment to another, such that strips of plants having different widths are obtained.

Figure 22:
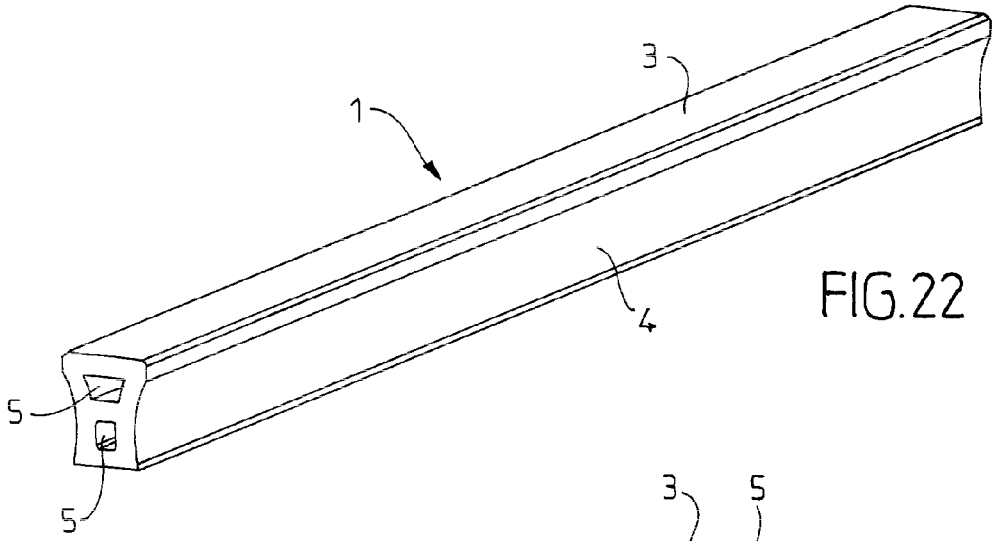
FIG. 22 is a perspective view of a variant embodiment of the construction element.
Figure 23:
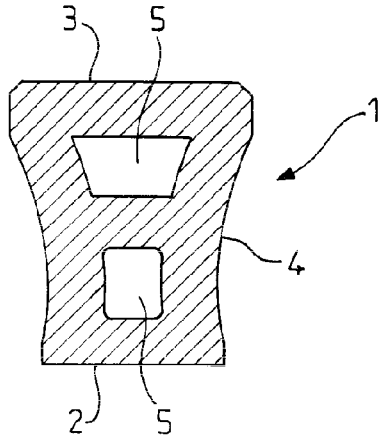
FIG. 23 is a cross-sectional view of the construction element from FIG. 22.
Figure 24:
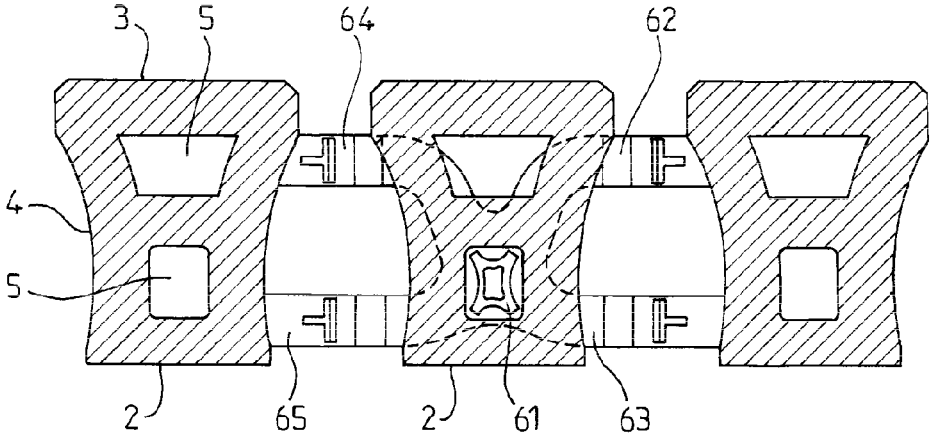
FIG. 24 shows the fitting together of three lines of construction elements according to FIGS. 22 and 23.

FIGS. 22, 23 and 24 illustrate a variant embodiment of the construction element, the same elements having the same references.

Apart from with regard to FIG. 7, in all of the examples described above, the upper and lower parts have the same height and the same width. By contrast, in the variant embodiment in FIGS. 22 to 24, the lower part of the construction element 1 has a smaller height and a smaller width.

Thus, the width of the upper part is around 57 mm, while that of the lower part is around 43 mm The height of the upper part is around 13 mm, with that of the lower part being around 4 mm.

As in the preceding examples, longitudinal recesses 5 are made in the upper and intermediate parts. There is no such recess in the lower part.

FIG. 24 shows that the adjacent lines of construction elements 1 are joined together by means of the same fasteners as those illustrated in FIGS. 15 to 20.

The use of the construction elements in FIGS. 22 to 24 is the same as that in the preceding embodiments, except that, since they do not have the same solidity as the latter, their use is preferably reserved for areas in which pedestrians or light vehicles move around.

Figure 16:
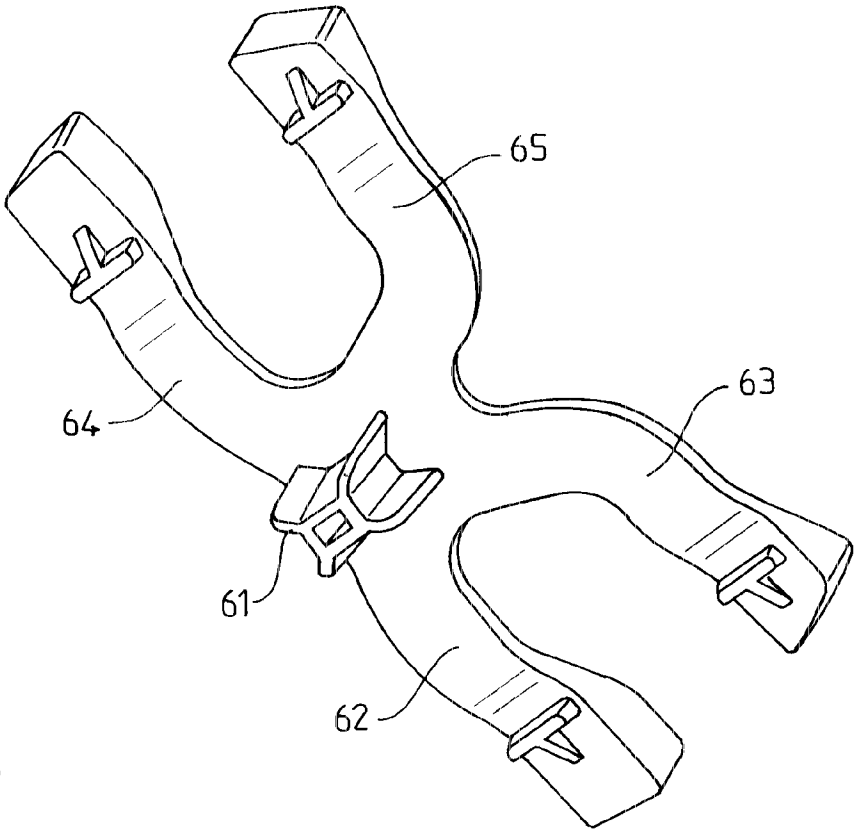
FIG. 16 is a perspective view of the other side of the fastener from FIG. 14.
Figure 15:
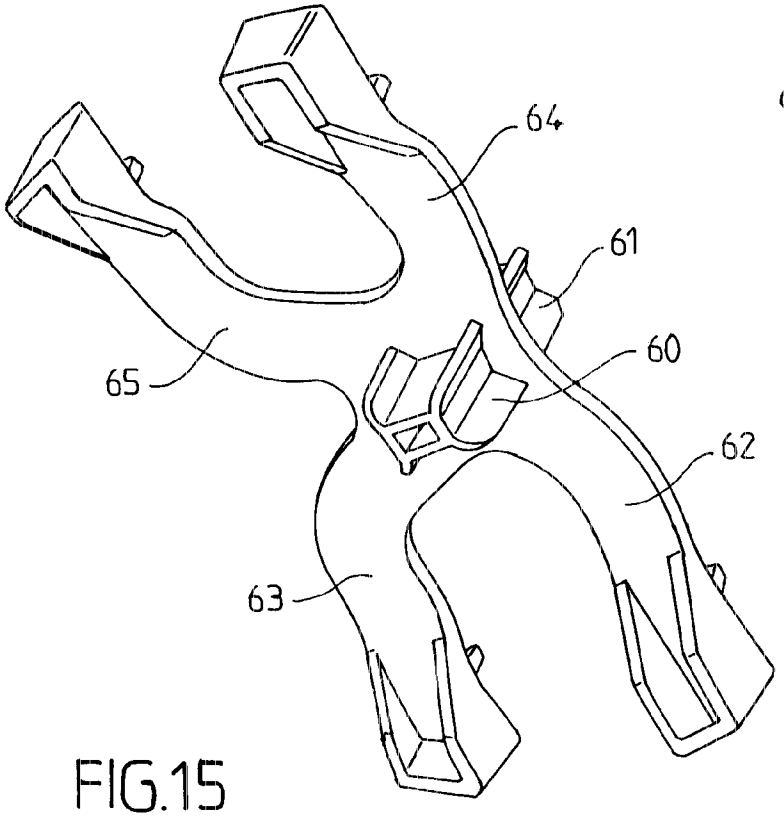
FIG. 15 is a perspective view of one side of the fastener from FIG. 14.
Figure 25:
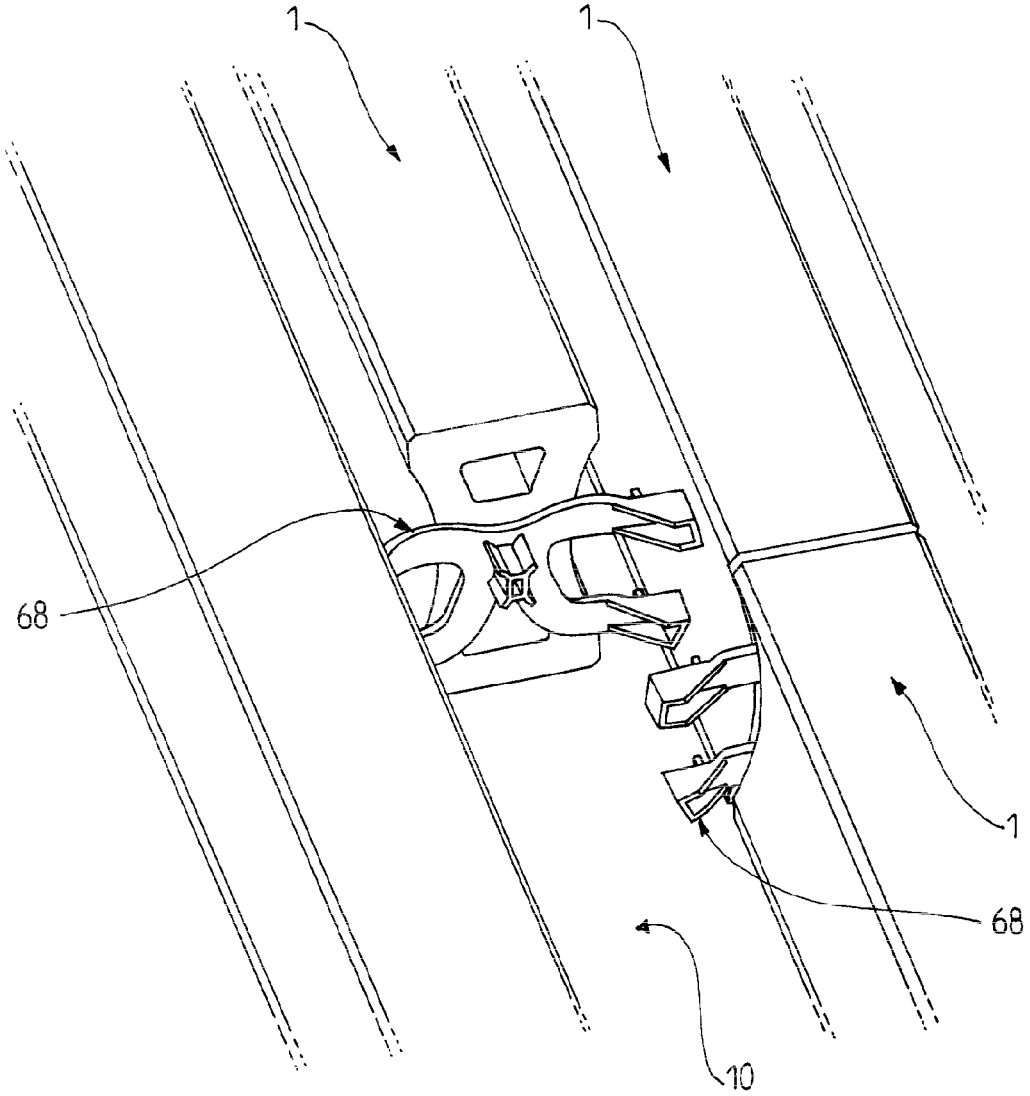
FIG. 25 illustrates the placement of construction elements according to FIG. 1 with offset joints.

The securing fasteners 68 according to FIGS. 15 and 16, which are placed at the joints between construction elements 1 of the lines, can be arranged with aligned joints, as FIGS. 18 to 21 show, or with offset joints, as FIG. 25 shows.

Although the invention has been described in conjunction with a number of particular embodiments, it is quite clear that it is in no way limited thereto and that it comprises all technical equivalents of the means described and combinations thereof where these fall within the scope of the invention.

The use of the verb "to have", "to comprise" or "to include" and the conjugated forms thereof does not exclude the presence of elements or steps other than those stated in a claim. The use of the indefinite article "a/an" or "one" for an element does not, unless mentioned to the contrary, exclude the presence of a plurality of such elements.

In the claims, any reference sign between parentheses cannot be interpreted as implying any limitation of the claim.

The invention claimed is:

1. A pavement for vehicles and pedestrians, formed by a conventional foundation of stones and sand on which there are placed construction elements having: an upper surface and a flat lower surface which are connected together by a narrowed intermediate part, the space between the narrowed parts of two adjacent lines being filled with soil or compost in which a decorative plant is planted, wherein said construction elements have an elongate shape and are arranged end-to-end in adjacent parallel lines, the upper surface of the construction element is flat, and wherein a line has a plurality of construction elements placed end-to-end, stabilizing means being arranged so as to cooperate with the construction elements of two adjacent lines in order to improve the stability of the latter, the construction elements having longitudinal recesses, the stabilizing means having securing pieces interposed between the construction elements of a line, the securing piece having a body which is arranged between the longitudinal ends of the two construction elements placed end-to-end and carries rods or protuberances housed in the longitudinal recesses in the two construction elements between which said body is arranged so as to maintain the alignment of the two construction elements.

2. The pavement as claimed in claim 1, wherein the securing piece also has at least one pair of arms that project on either side of the body perpendicularly to the line of construction elements, each arm of said pair bearing against a construction element (1) of an adjacent line.

3. The pavement as claimed in claim 2, wherein the ends of the arms of the securing piece (58) are provided with feet, the shape of which corresponds to the profile of the lateral surfaces of the construction elements against which said feet bear.

4. The pavement as claimed in claim 2, wherein the lateral arms on either side of the securing piece have a curved shape and are provided at their ends with bearing means intended to bear against the sidewalls of two construction elements located on each side of the construction element which carries the securing piece, these bearing means having three walls arranged in a U-shape, the middle wall being curved so as to correspond to the curvature of the sidewalls of the construction elements against which said middle walls bear.

5. The pavement as claimed in claim 4, wherein each arm is provided, on the opposite side to the bearing means, with a wedge, the position of the wedges of the arms being determined such that these wedges bear against one another when the securing pieces or fasteners are fitted.

6. The pavement as claimed in claim 5, wherein the ends of the arms are offset with respect to the plane of the securing piece or fastener, the latter being in an inverted position such that the wedges can be anchored against one another.

7. The pavement as claimed in claim 1, wherein the body of the securing piece also carries spacing rods that are arranged on either side of the line of construction elements and extend parallel to the line of construction elements.

8. The pavement as claimed in claim 1, wherein the construction element is produced from ceramic material.

9. The pavement as claimed in claim 1, wherein the stabilizing means have spacing means for keeping the spacing between the two adjacent lines of construction elements constant.

10. The pavement as claimed in claim 6, wherein the stabilizing means have strips, the width of which is the same as the desired spacing between the lines and which are sunk vertically into the foundation, said strips projecting from the foundation to a height less than or equal to that of the construction elements of which said lines are made.

11. The pavement as claimed in claims 1, wherein a construction element has two vertically separated symmetrical half-elements, each half-element having a recess, a parallelepipedal block being slotted into said recesses in order to connect the two half-elements.

12. The pavement as claimed in claim 1, wherein the construction elements have a length of between 0.30 m and 1.80 m, a height of between 50 and 150 mm, a width of between 35 and 100 mm, the alignments being spaced apart from one 30 another by 15 mm to 20 mm.

13. The pavement as claimed in claim 1, wherein the spacing between two adjacent alignments of construction elements is determined by an assembly consisting of two adjacent securing pieces and a connecting member arranged between the two securing pieces.

14. The pavement as claimed in claim 13, wherein the connecting member is a third securing piece.

15. The pavement as claimed in claim 1, wherein the construction elements have upper and lower parts having the same width and same height.

16. The pavement as claimed in claim 1, wherein the construction elements have a lower part having a width and a height that are less than those of the upper part.

17. The pavement as claimed in claim 16, wherein the construction elements have an overall height of around 67 mm, the upper part a height of around 13 mm and a width of around 57 mm, and the lower part a height of around 4 mm and a width of around 43 mm.

* * * * *